US007238064B2

(12) United States Patent
Nakamura et al.

(10) Patent No.: US 7,238,064 B2
(45) Date of Patent: Jul. 3, 2007

(54) TERMINAL FITTING AND A BLANK THEREFOR

(75) Inventors: Keiichi Nakamura, Yokkaichi (JP); Yutaka Noro, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/345,417

(22) Filed: Feb. 1, 2006

(65) Prior Publication Data

US 2006/0172623 A1 Aug. 3, 2006

(30) Foreign Application Priority Data

Feb. 2, 2005 (JP) ..... 2005-026668

(51) Int. Cl.
*H01R 4/18* (2006.01)

(52) U.S. Cl. ..... 439/884

(58) Field of Classification Search ..... 439/884, 439/885, 889, 595, 866
See application file for complete search history.

(56) References Cited

U.S. PATENT DOCUMENTS

| | | | | |
|---|---|---|---|---|
| 5,478,263 | A * | 12/1995 | Kato | 439/752 |
| 6,244,900 | B1 | 6/2001 | Ishikawa et al. | |
| 6,398,599 | B1 * | 6/2002 | Irikura et al. | 439/884 |
| 6,402,575 | B1 * | 6/2002 | Suzuki | 439/884 |
| 2002/0025696 | A1 | 2/2002 | Irikura et al. | |
| 2003/0068932 | A1 | 4/2003 | Takatsuki et al. | |
| 2003/0190841 | A1 * | 10/2003 | Nakamura et al. | 439/595 |

* cited by examiner

*Primary Examiner*—Alexander Gilman
(74) *Attorney, Agent, or Firm*—Gerald E. Hespos; Anthony J. Casella

(57) ABSTRACT

A male terminal fitting (1) has a rectangular tube (4). A cut is made in wall of the rectangular tube (4) to form a stabilizer (20) and produces a cut hole (22). An end edge of a closing plate (21) is arranged to face the cut hole (22) and a closing piece (23) is formed at a rear-end opening of the rectangular tube (4). The closing plate (21) and the covering piece (23) substantially prevent external matter or a leading end of another male terminal fitting (1) from intruding into the rectangular tube (4).

13 Claims, 11 Drawing Sheets

TERMINAL FITTING AND A BLANK THEREFOR

BACKGROUND OF THE INVENTION

1. Field of the Invention

The invention relates to a terminal fitting, to a plate material therefor and to a method of forming a terminal fitting.

2. Description of the Related Art

U.S. Pat. No. 6,244,900 discloses a male terminal fitting with a rectangular tubular main portion that has an upper wall formed with a locking hole for engaging a projecting lock in a connector housing. Stabilizers project from edges of side walls of the main portion at opposite sides of the locking hole to prevent erroneous insertion, such as an upside-down insertion, of the male terminal fitting into a cavity.

The stabilizers, in many cases, are formed by making cuts in the main portion and bending the cut portions. The cut hole left by forming the stabilizers can be used as part of the locking hole. The male terminal fittings frequently are handled in large numbers prior to use. In such cases, external matter, such as the leading end of another male terminal fitting, can enter the cut hole of the main portion and deform the terminal fitting.

The invention was developed in view of these problems and an object thereof is to reduce a likelihood of intrusion of external matter into a cut hole.

SUMMARY OF THE INVENTION

The invention relates to a terminal fitting formed by bending a blank sheet of flat material. The terminal fitting has a substantially polygonal tube. A wall of the tube is cut and the cut portion is bent to define at least one stabilizer that projects from the tube. At least one closing plate bulges out from an area of the blank that will be formed into the tube. The bulge is shaped to close at least part of the hole that is cut to form the stabilizer. Accordingly, external matter cannot intrude easily into the tube hole that is cut to form the stabilizer.

An opening preferably is formed at the rear end of the tube, and the closing plate preferably is formed integrally or unitarily with a closing piece for at least partly closing the opening at the rear end of the tube. Accordingly, external matter simultaneously is prevented from entering the tube through the cut hole and through the opening at the rear end of the tube.

The closing plate preferably extends along forward and backward directions substantially parallel with the area of the flat blank that will be formed into the tube and is at a widthwise outer side.

The closing plate preferably is folded so that a front part of the closing plate is placed on a rear part thereof. The cut hole preferably can be closed by end edges of both front and rear parts of the closing plate.

Consideration may be given to having a plate surface face the cut hole instead of the end edge of the closing plate. However, such a design would cause the closing plate to bulge out farther and would lead to a less desirable shape for the blank. The blank is better if the closing plate extends in forward and backward directions parallel with the area to be formed into the tube. An area necessary to close the cut hole is gained by folding the closing plate so that an end edge faces the cut hole.

The length of the closing plate along forward and backward directions preferably is substantially equal to a corresponding dimension of the cut hole left by forming the stabilizer.

The stabilizer preferably is formed by making a substantially U-shaped slit in an area of the blank so that both ends of the slit are substantially on a bend of the polygonal tube.

The invention also relates to a blank of plate material for forming a terminal fitting. The blank is a substantially planar sheet shaped to allow a polygonal tube to be formed by bending the sheet. The sheet has at least one cut formed so that at least one stabilizer can be formed as the blank is bent to form the tube. At least one closing plate is formed to bulge out from an area of the blank that will be formed into the tube. The closing plate is shaped to at least partly close a cut hole left by the cut that forms the stabilizer.

A closing piece may extend from the closing plate of the blank and may be configured to close an opening at the rear end of the tube.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A terminal fitting according to the invention is identified by the numeral 1 in FIGS. 1 to 10. The phrase vertical direction VD is used herein to describe the vertical orientation in FIG. 1 and the phrase forward and backward directions FBD is used to describe the horizontal orientation in FIG. 1. Additionally, the front of the terminal fitting 1 is at the right side of FIG. 1, and is the end of the terminal fitting 1 that will be connected to a mating terminal fitting. The width direction WD is the horizontal orientation in FIG. 3 and the vertical orientation in FIG. 1.

Figure 10:
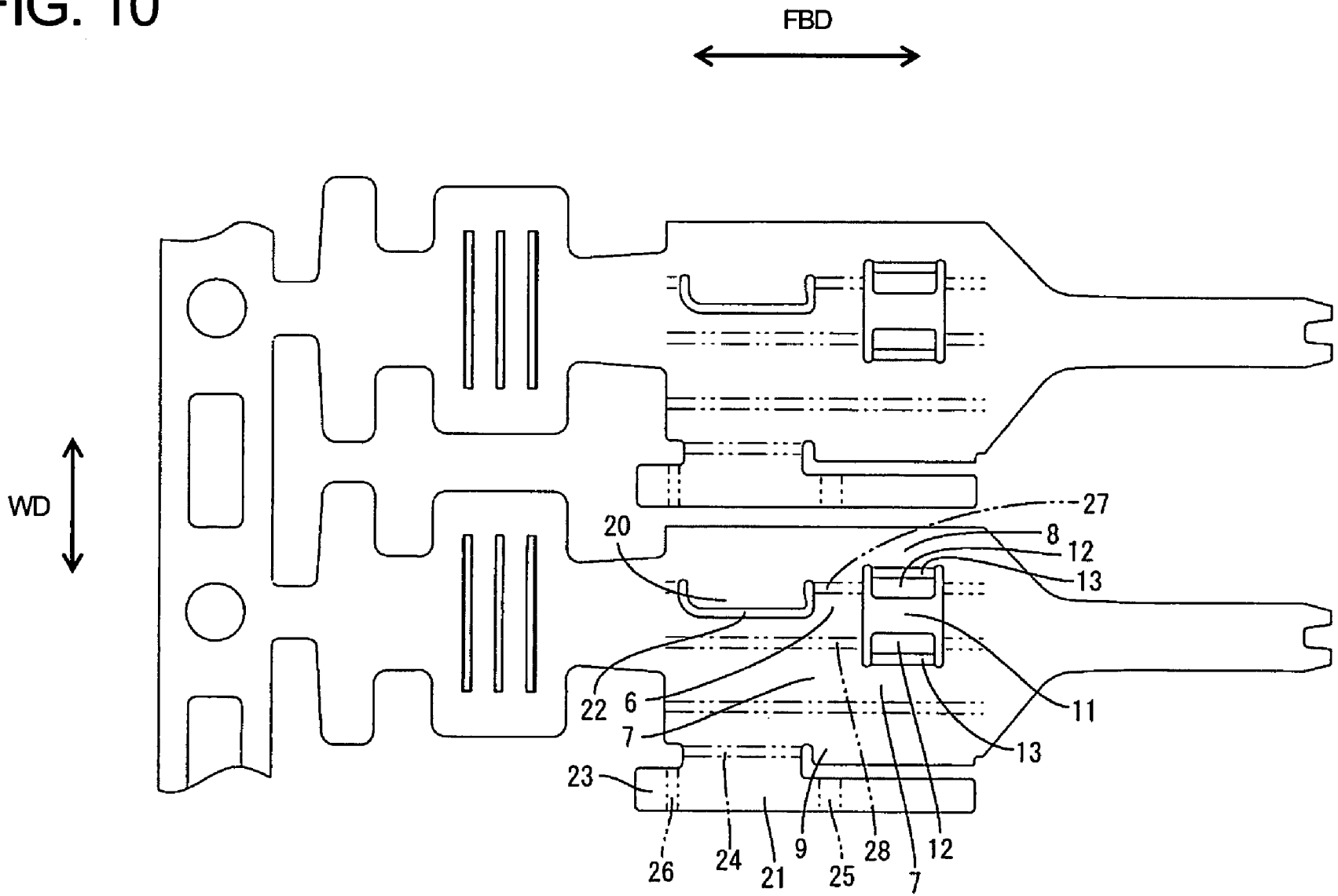
FIG. 10 is a blank for forming the male terminal fitting.

The male terminal fitting 1 of this is formed by bending an initially flat conductive metallic blank as shown in FIG. 10. The male terminal fitting 1 has opposite front and rear ends. An insulation barrel 2 is formed at the rear end and is configured to be crimped, bent or folded into connection with an insulation coating of a wire (not shown). A wire barrel 3 is forward of the insulation barrel 2 and is configured to be crimped, bent or folded into connection with a conductive core of the wire exposed from the insulation coating. A rectangular tube 4 is forward of the wire barrel 3 and a contact 5 projects forward from the front end of the rectangular tube 4.

Figure 1:
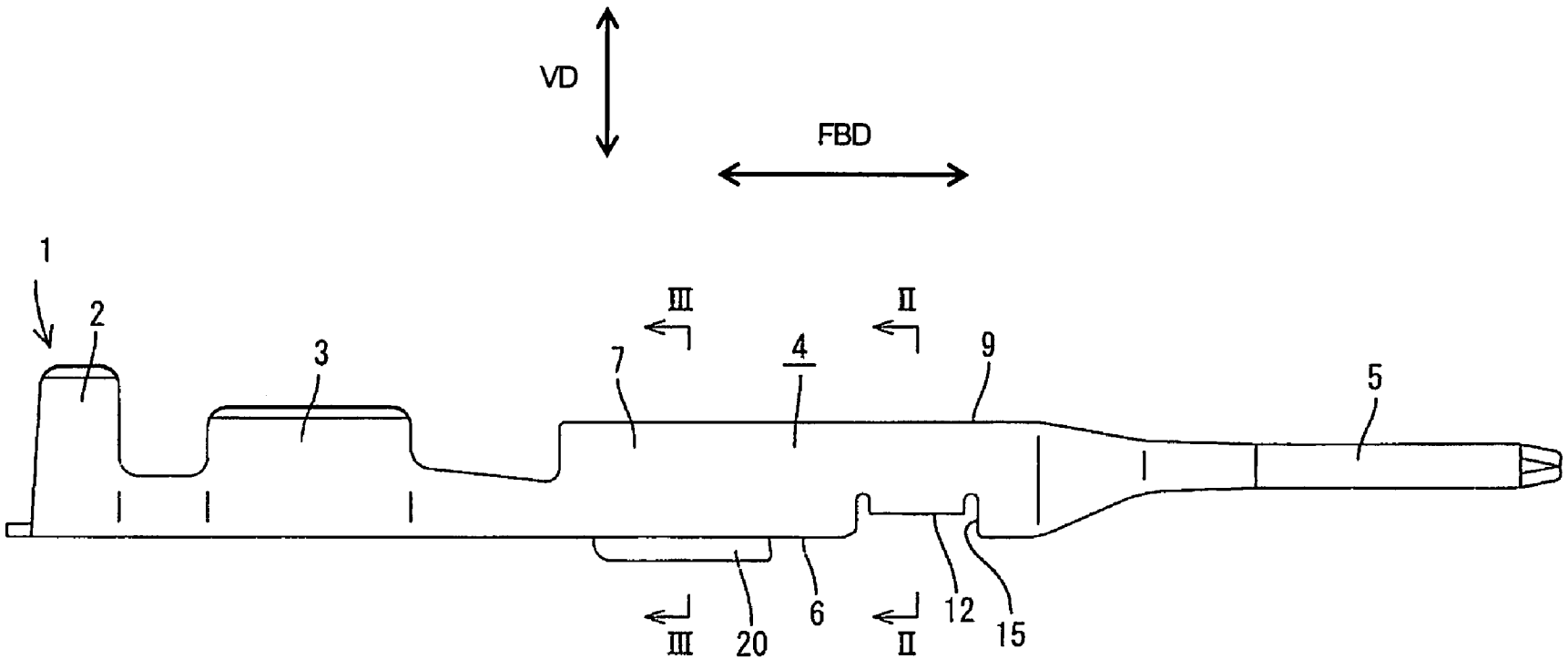
FIG. 1 is a left side view of a male terminal fitting according to one embodiment of the invention.
Figure 2:
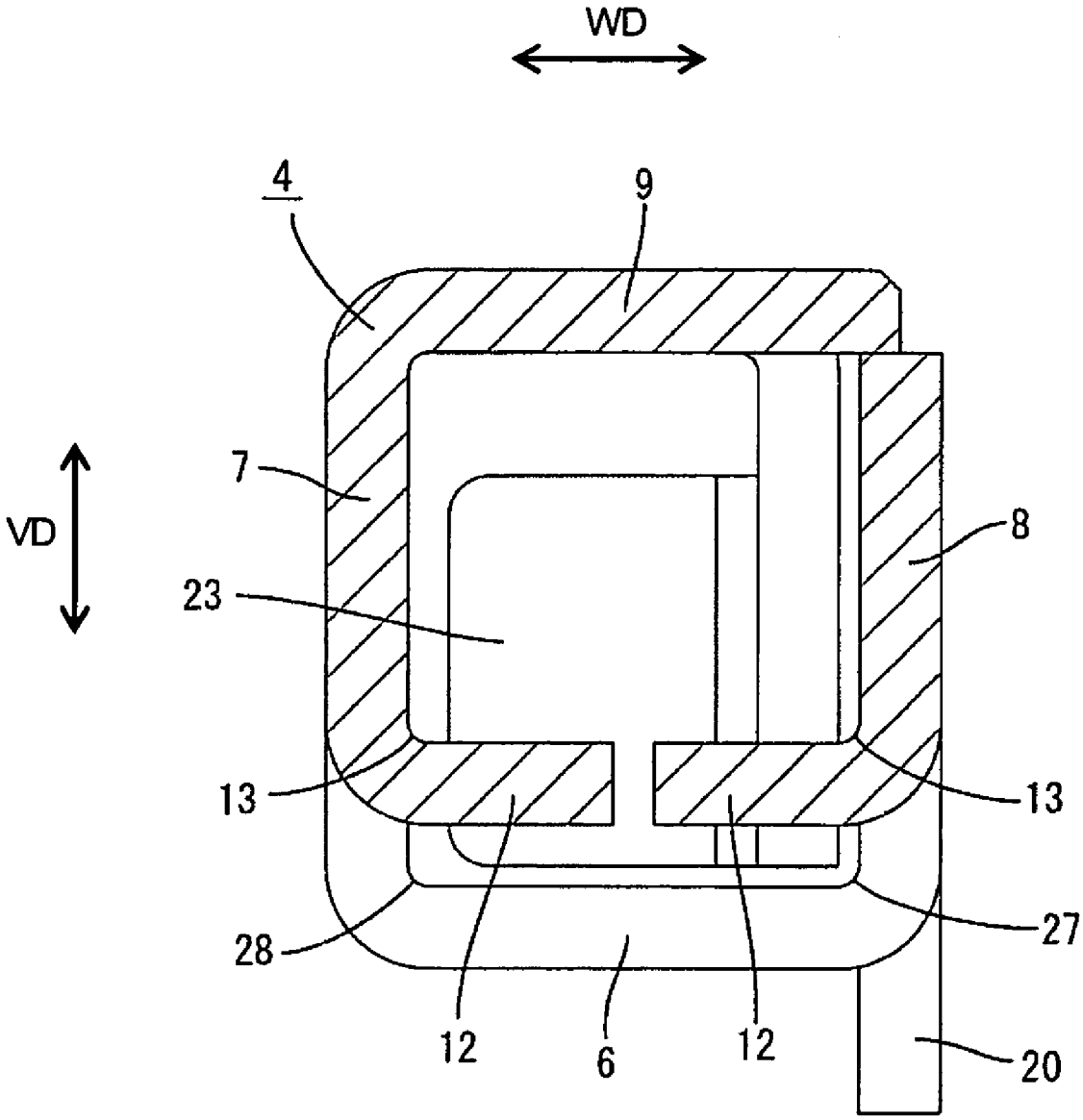
FIG. 2 is a section along II—II of FIG. 1.
Figure 3:
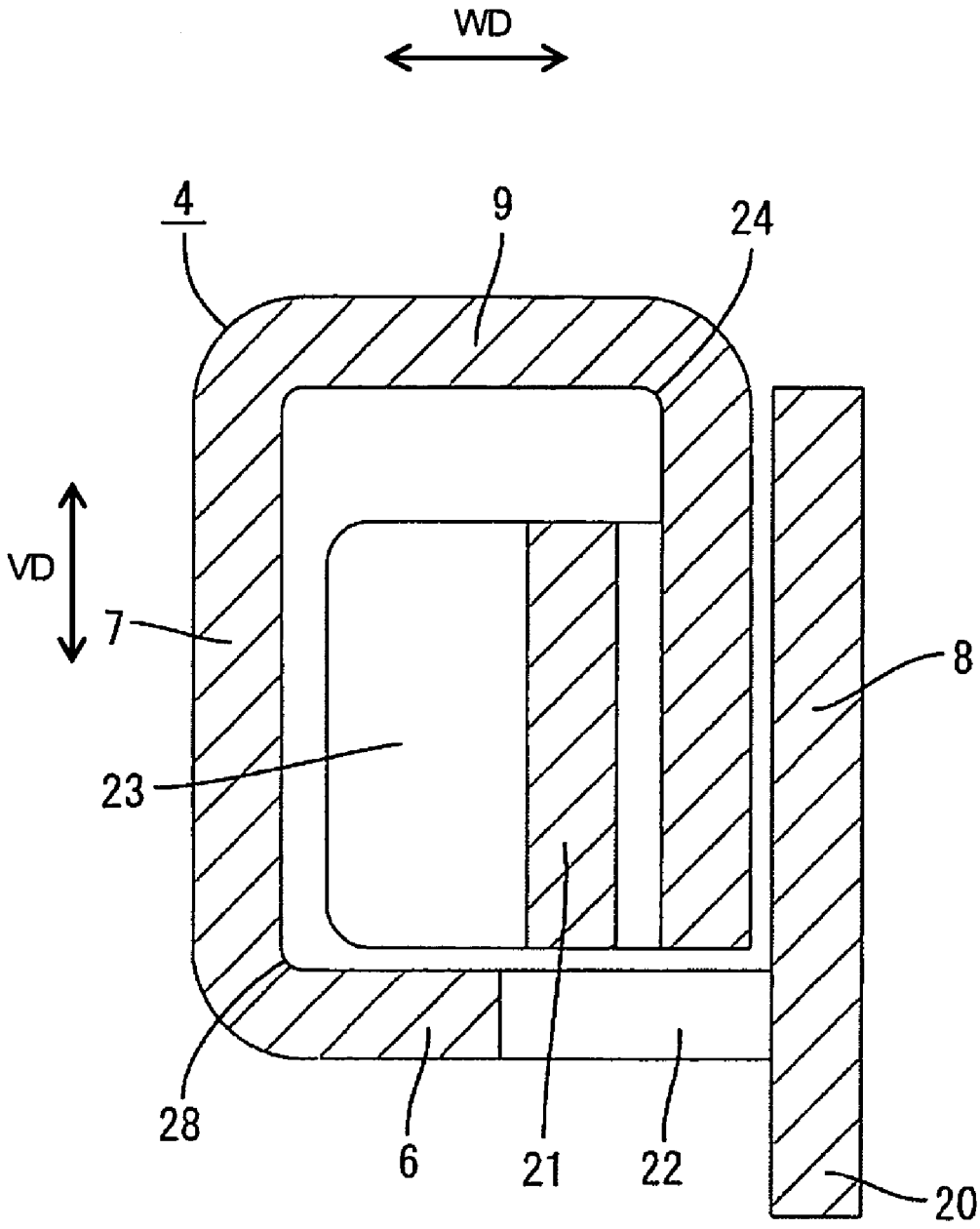
FIG. 3 is a section along III—III of FIG. 1.
Figure 4:
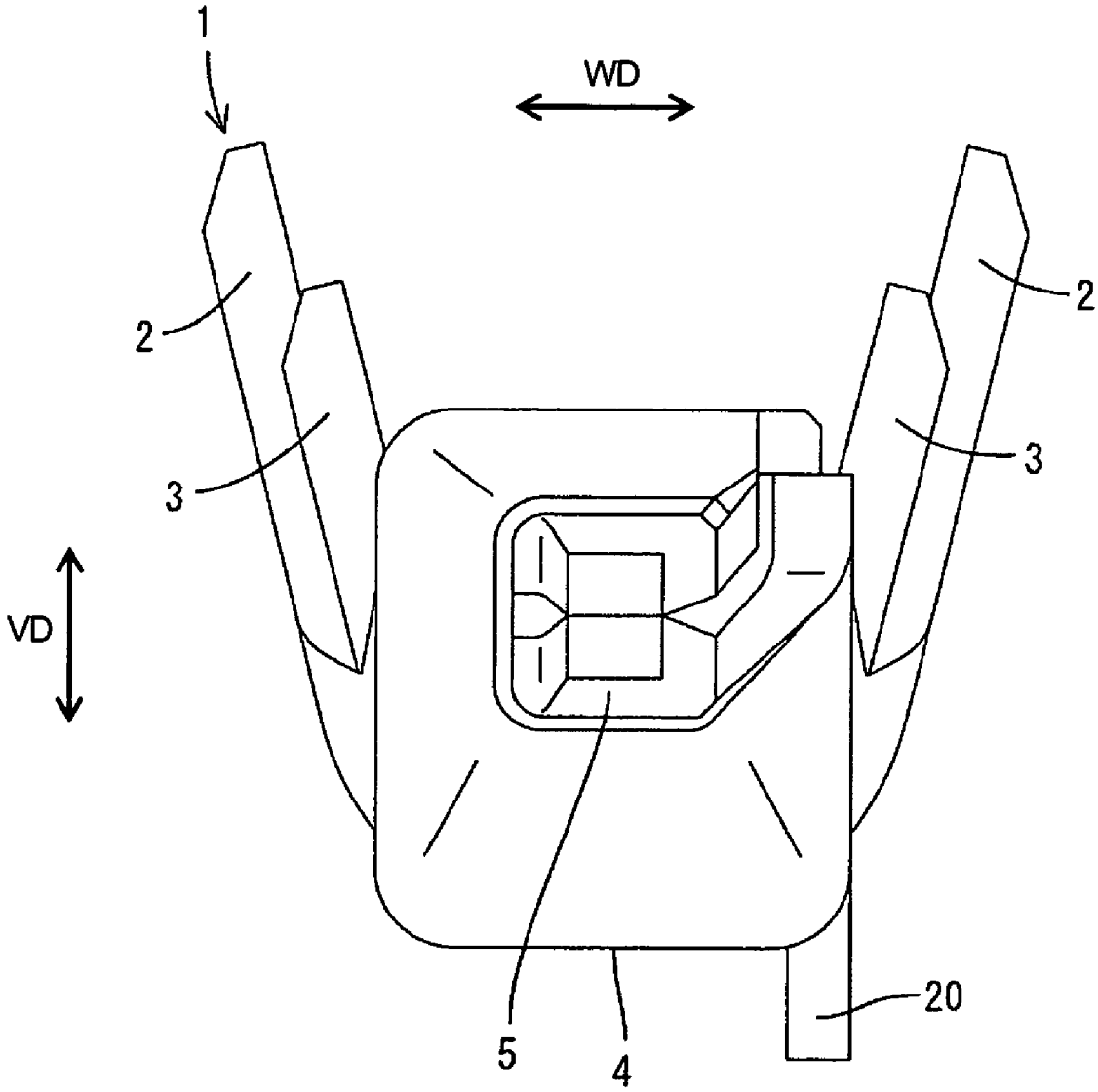
FIG. 4 is a front view of the male terminal fitting.
Figure 5:
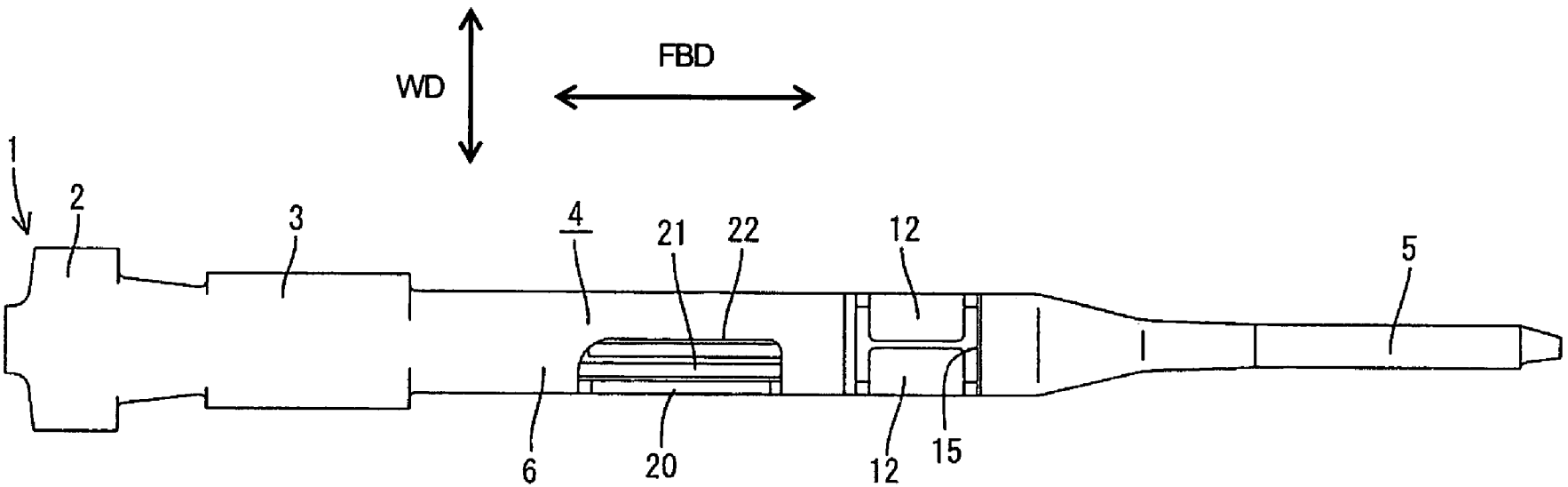
FIG. 5 is a bottom view of the male terminal fitting.
Figure 6:
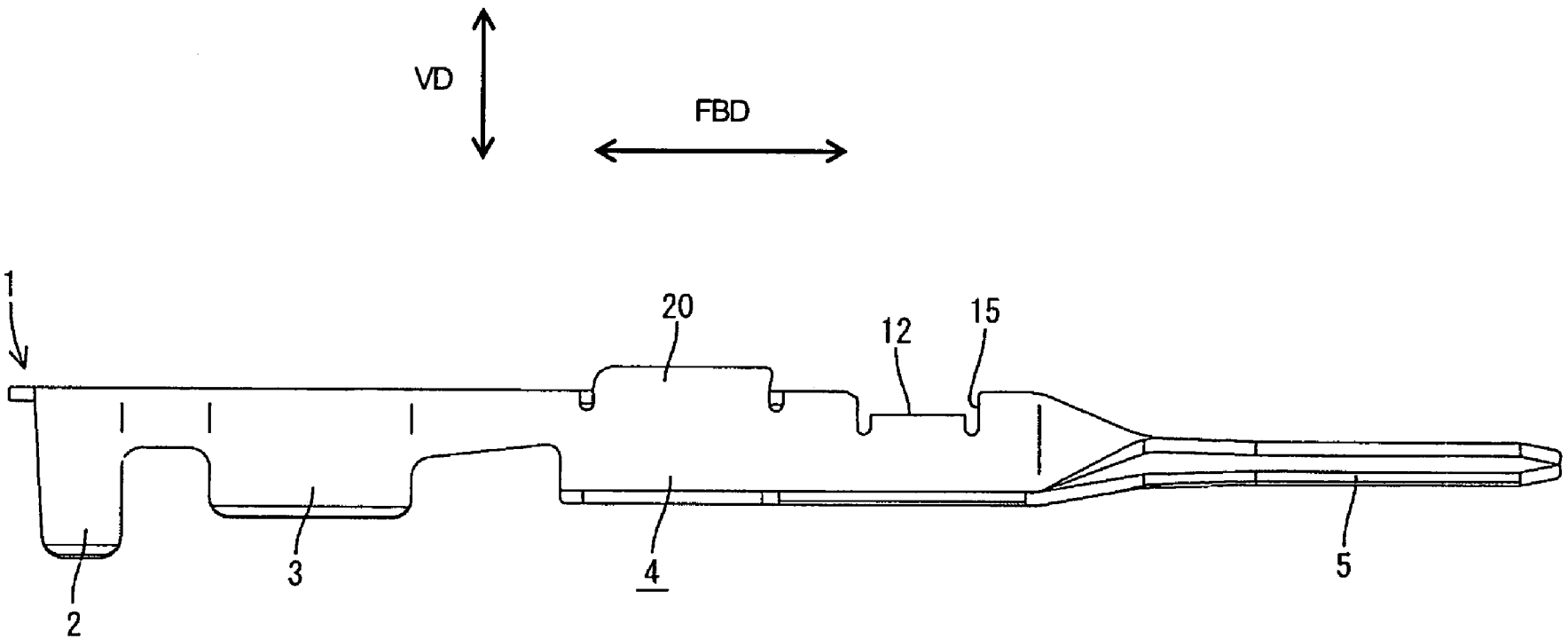
FIG. 6 is a right side view of the male terminal fitting.
Figure 7:
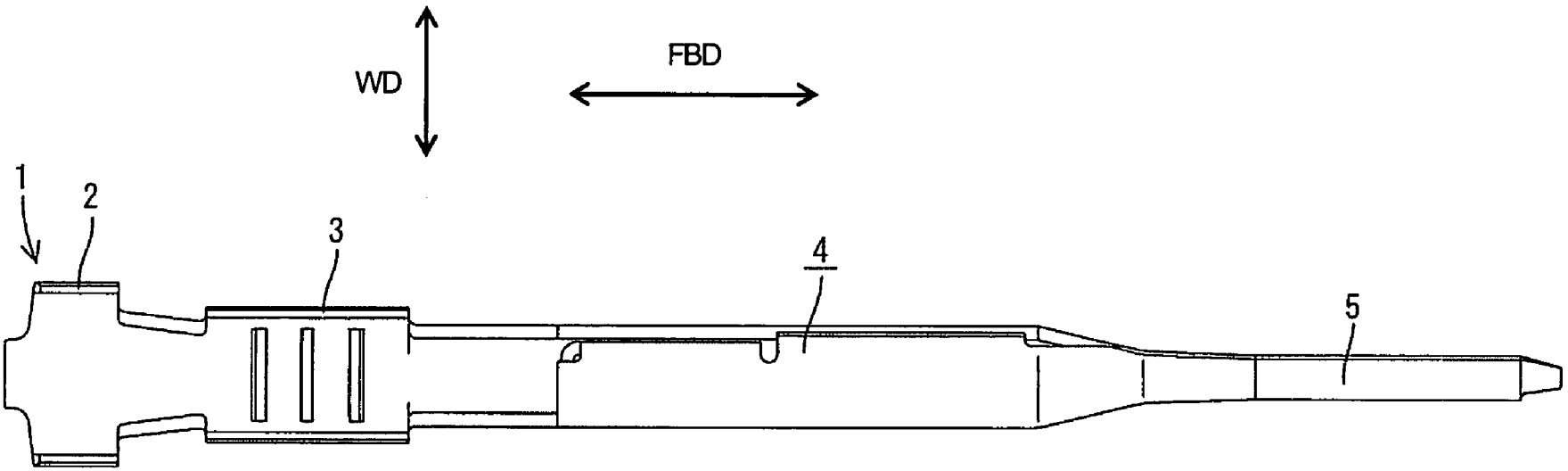
FIG. 7 is a plan view of the male terminal fitting.
Figure 8:
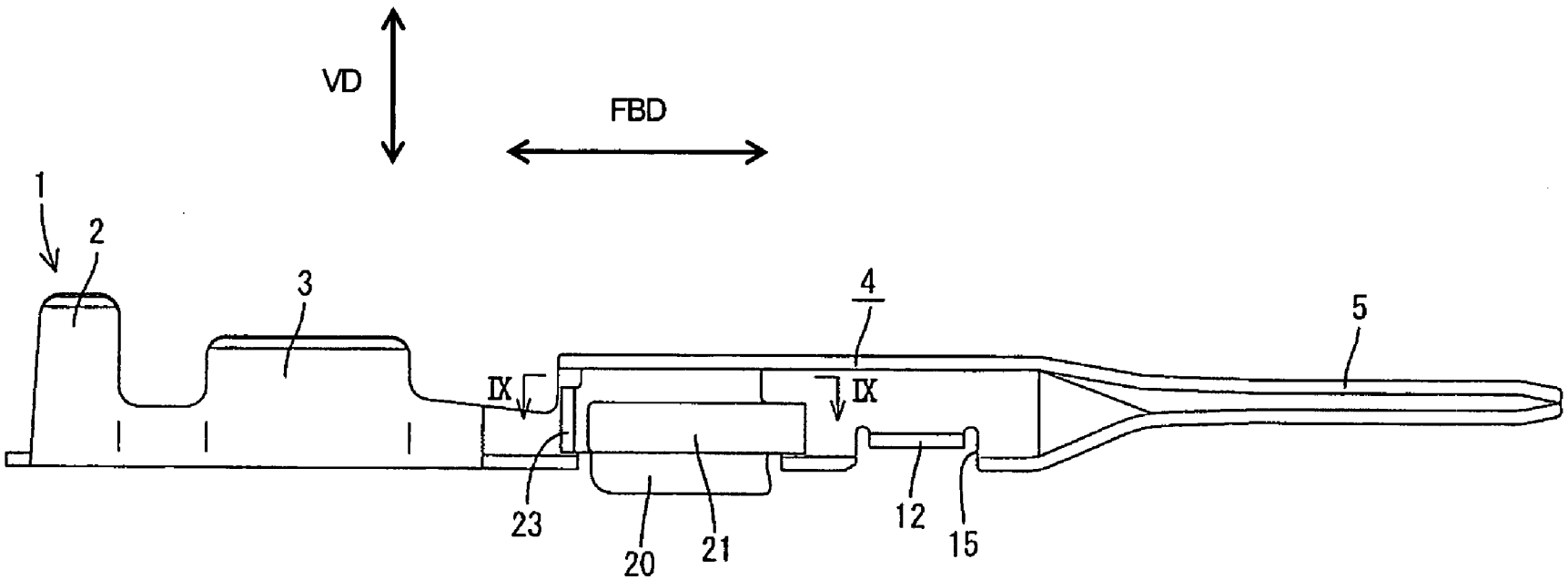
FIG. 8 is a longitudinal section of the male terminal fitting.

As shown in FIG. 3, the rectangular tube 4 is long in forward and backward directions FBD, and bottom plate 6 and first and second side plates 7, 8 bent at right angles from the bottom plate 6 so that the side plates are substantially opposed to each other. A top plate 9 then is bent at a right angle from a top portion of the first side plate 7 to oppose the bottom plate 6. A front part of the rectangular tube 4 is substantially continuous with the terminal contact portion 5 to be connected with a female terminal fitting (not shown) and has a V- or U-shaped cross section that is open sideways.

At least one stabilizer 20 projects down from the bottom of the second side plate 8 (FIG. 3) at a rear part of the rectangular tube 4. The stabilizer 20 prevents the male terminal fitting 1 from being inserted into a cavity of a male connector housing in an improper posture, such as an upside down insertion. More particularly, the male terminal fitting 1 is inserted into the cavity by aligning the stabilizer 20 with a guide groove (not shown) formed in the male connector housing. The stabilizer 20 is formed by making a substantially U-shaped slit from the second side plate 8 to the bottom plate 6 in a development or plane view of the male terminal fitting 1, so that both ends of the U-shaped slits are on a bending edge 27 formed by bending the second side plate 8 from the bottom plate 6. Thus, the stabilizer 20 is formed simultaneously with the bending of the second side plate 8. As a result, the stabilizer 20 is substantially in flush with the second side plate 8 and projects down from the bottom plate 6. The formation of the stabilizer 20 by cutting and bending also forms a cut hole 22 on the bottom wall 6 substantially conforming to the shape of the stabilizer 20. The cut hole 22 is closed by a closely folded portion 21 to prevent or reduce the likeliness of intrusion of external matter or the like from the outside.

Figure 9:
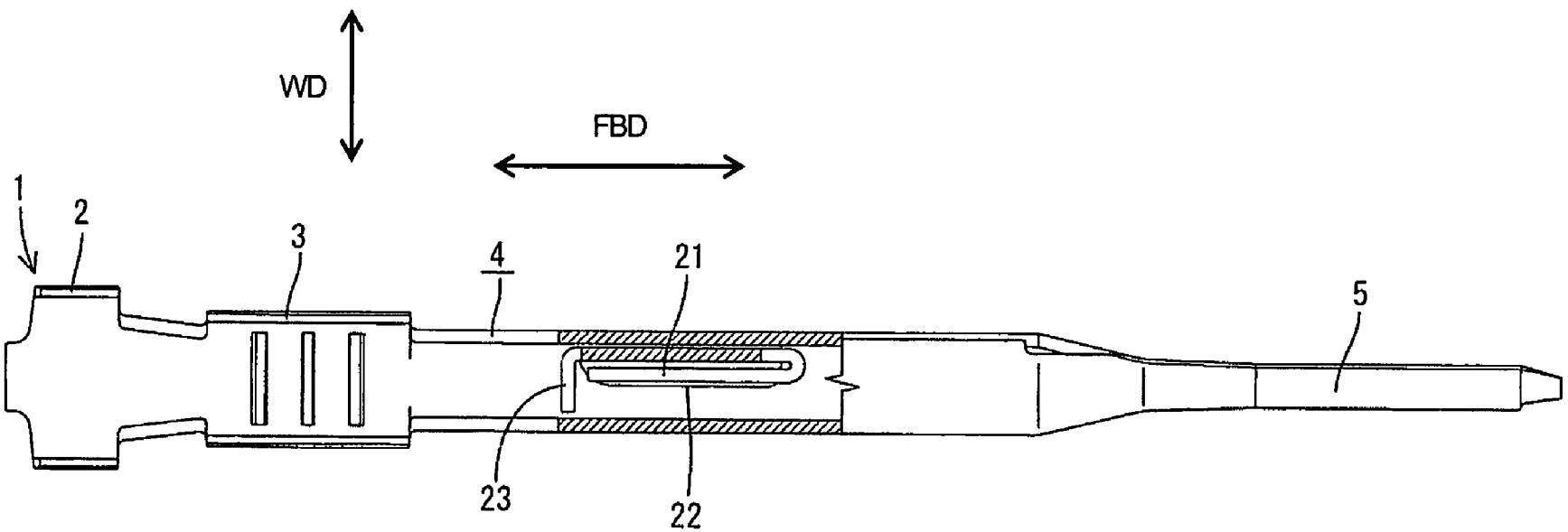
FIG. 9 is a plan view partly in section along IX—IX of FIG. 8.

The closely folded portion 21 is coupled unitarily to a rear part of the top plate 9 by a connecting piece 24 on the blank for forming the male terminal fitting 1, as shown in FIG. 10. The connecting piece 24 extends substantially in forward and backward directions FBD and is at a position along the forward and backward directions FBD of the blank of FIG. 10 substantially opposed to the U-shaped slit that forms the stabilizer 20. Additionally, the length of the connecting piece 24 is approximately the same as the dimension of the U-shaped slit along the forward and backward directions FBD. A covering piece. 23 is formed at the rear end of the closely folded portion 21 and projects more backward on the blank than the rear end of the rectangular tube 4. On the other hand, the leading end of the closely folded portion 21 is at substantially the same position as the front end of the rectangular tube 4. A front half of the closely folded portion 21 is bent substantially 180° about a bend line 25, as shown in FIG. 10 into close contact with a surface of the rear half of the closely folded portion, as shown in FIG. 9. The length of this doubled portion along forward and backward directions FBD is substantially equal to a corresponding dimension of the cut hole 22 left by forming the stabilizer 20. The doubled portion is bent by substantially 90° along the longitudinal direction of the connecting piece 24 to extend up from the plane of FIG. 10. Further, the covering piece 23 is bent by substantially 90° along the bending line 26 to extend up from the plane of FIG. 10. As a result, the covering piece 23 is disposed to close an opening at the rear end of the rectangular tube 4. In this way, the closely folded portion 21 is located at the cut hole 22 of the stabilizer 20 substantially in the entire length range of the doubled portion, and substantially entirely closes the cut hole 22.

As shown in FIG. 10, a substantially H-shaped punch hole 11 is formed near the front end of the bottom plate 6, and two closing pieces 12 are substantially opposed to each other in the punch hole 11. The width of the punch hole 11 stretches from the bottom plate 6 to parts of the opposite side plates 7, 8. Both closing pieces 12 are bent substantially 90° along bending lines 13 at their base ends to extend up from the plane of FIG. 10. At this time, the bending lines 13 are at positions more outward than bending lines 27, 28 of the side plates 7, 8 with respect to the width direction WD. As a result, the outer surfaces of the closing pieces 12 are retracted slightly from the outer surface of the bottom plate 6 by a dimension slightly larger than the thickness of the bottom plate 6 in an inward direction ID that is substantially parallel to the vertical direction VD and substantially normal to the forward and backward directions FBD. Thus, the front edge of the punch hole 11 is exposed over substantially the entire width to form a locking edge 15 that is engageable with a lock (not shown) of the male housing. Although the leading ends of the closing pieces 12 are spaced apart by a specified distance in the blank of the male terminal fitting 1, they can be opposed to each other with almost no clearance therebetween to avoid or reduce the likeliness of the intrusion of external matter.

As described above, the punch hole 11 is formed in an area extending from or from close to the bottom plate 6 to the parts of the side plates 7, 8, and the closing pieces 12 are opposed to each other in the punch hole 11. Thus, the locking edge 15 for engaging the lock can be formed without forming an opening, and the intrusion of external matter into the rectangular tube 4 can be prevented. As a result, even if the male terminal fittings 1 are handled in a large numbers, the leading end of the terminal contact portion 5 of one terminal fitting 1 will not intrude into the rectangular tube 4 of another terminal fitting 1 to be deformed. Further, the cut hole 22 left by forming the stabilizer 20 and the opening at the rear end of the rectangular tube 4 are closed by the closely folded portion 21 and the covering piece 23 formed in the rectangular tube portion 4 beforehand. Therefore, neither the terminal contact portion 5 nor external matter can intrude into the rectangular tube 4.

The male terminal fitting 1 illustrated in this embodiment is assumed to be a small-size, and the locking edge 15 needs to be as deep and wide as possible to ensure a sufficient locking force when engaged with the lock. Thus, it is desirable to form the locking edge 15 that extends over substantially the entire width of the side of the rectangular tube 4. However, external matter may intrude through such an opening. Accordingly, consideration might be given to forming one side wall of the rectangular tube as a double-wall structure. Part of the outer wall of this double wall structure could then be removed to form the locking edge 15. However, this possible design is less advantageous than the above-described embodiment because the size of the male terminal fitting would be increased by the thickness of one plate due to the double-wall structure. In this respect, the terminal fitting 1 of the subject invention achieves a sufficient engaging depth with the lock by forming the locking edge 15 that is engageable with the lock over substantially the entire width of the male terminal fitting 1 and freely adjusting the height of the closing pieces 12. Further, the intrusion of external matter can be prevented since no opening is formed at a position of the male terminal fitting 1 to be engaged with the lock.

FIG. 11(A) to (C) show different folded portions 21 according to modified embodiments of closing plates having different shapes but being all arrangeable such that the cut hole 22 is substantially fully closed the respective closing portion to prevent or reduce the likeliness of the intrusion of external matter or the like from the outside.

Figure 11:
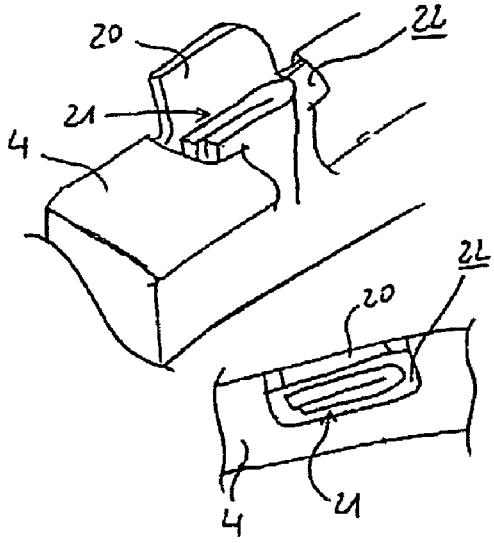
FIGS. 11 (A) to (C) show schematic views of covering plates according to several modified embodiments of the present invention.
Figure 11:
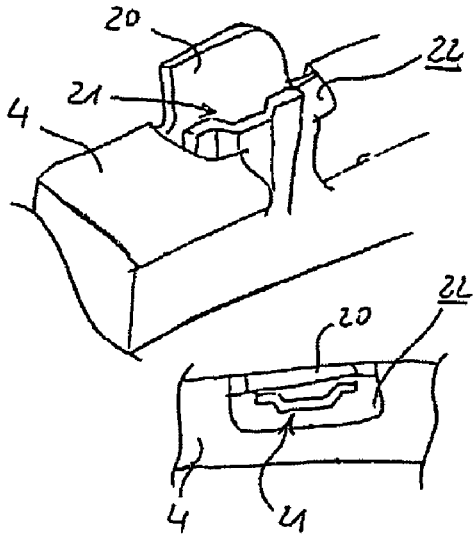
Figure 11:
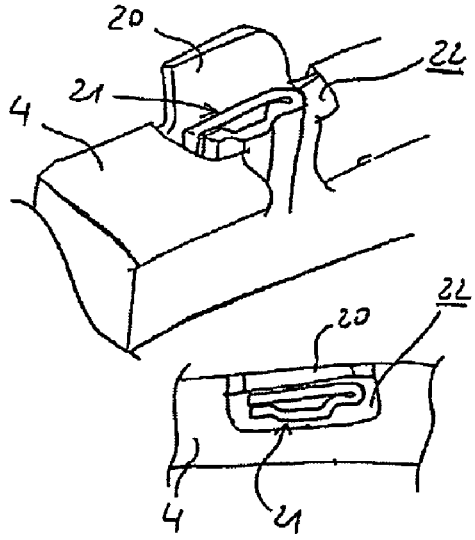

In the embodiment shown in FIG. 11 (A) the folded portion 21 is folded similarly to FIG. 9 so that upon bending the closely folded portion 21, a substantially front half is bent by an angle of substantially 180° along a specified bending line to be held in close contact with a major portion (e.g. more than about 70%, and preferably more than about 80%) of a surface of a substantially rear half thereof. Alternatively, as shown in FIG. 11 (B) the closing plate 21 is not folded back, but rather is bent, embossed or cranked to have an intermediate portion spaced from the respective side wall of the tube 4 so as to substantially have a bridge-like configuration. The length of the bridge-like closing plate 21 along forward and backward directions FBD is set to at least substantially equal to a corresponding dimension of the cut hole 22 left by forming the stabilizer 20. Even further alternatively, the closing plate may have a substantially V- or W-like shape or a bent or wavy-shape (not shown). With such configurations, the cut hole 22 can be closed at least partly closed to prevent external matter, such as a jig, from entering the cut hole 22. In the further modified embodiment of FIG. 11(C) the folded portion 21 is folded and bent to have an intermediate spaced portion spaced apart from the respective other portion of the folded portion 21 and to have a substantially folded bridge-like configuration. The length of this bridge-like portion along forward and backward directions FBD is at least substantially equal to a corresponding dimension of the cut hole 22 left by forming the stabilizer 20. A substantially front half of the folded portion 21 of FIG. 11(C) first is bent back by substantially 180° along a bending line to be held in close contact with a surface of a rear portion, then the bent portion further is bent or embossed to be spaced apart from the rear portion and to extend substantially parallel thereto for a specified distance and then is bent to come substantially into contact with the rear portion to form the folded bridge-like configuration or shape. The leading end of the closing portion 21 may be set at substantially the same position as the front end of the rectangular tube 4.

Although not shown in FIG. 11, the rear end or rear end of the folded portion 21 may project more back than the rear end of the rectangular tube portion to form a covering piece.

After (or before) the above-described bending, part of the closing portion 21 may be bent substantially 90° along the longitudinal direction of the connecting piece 24 to extend up from the plane of FIG. 10. Further, the covering piece 23 is bent substantially 90° along the bending line 26 to extend up from the plane of FIG. 10. As a result, the covering piece 23 is at an opening at the rear end of the rectangular tube 4 to at least partly close this opening. In this way, the closely folded portion 21 is at least partly at the cut hole 22 of the stabilizer 20 substantially in the entire length range of the doubled portion, and substantially entirely closes the cut hole 22.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The locking edge is formed in the bottom wall in the foregoing embodiment. However, the locking edge may be formed in any wall, such as the upper wall or the side wall.

The male terminal fitting is formed with the locking edge in the foregoing embodiment. However, the invention is also applicable to female terminal fittings formed with locking edges.

The closing pieces are substantially opposed to each other from the opposite side walls in the foregoing embodiment. However, one closing piece may extend from one side wall or two closing pieces may extend from substantially opposite side walls.

The opening left by the stabilizer is closed at least partly by the edge of the closely folded portion in the foregoing embodiment, but the closely folded portion is not necessary if a plate surface faces the opening. However, efficiency in blank cutout can be improved if the closely folded portion is substantially parallel with the rectangular tube and substantially extends in forward and backward directions FBD in the blank of the male terminal fitting, as in the foregoing embodiment.

Although the covering piece is formed at the closely folded portion in the foregoing embodiment, it may be formed at the rectangular tube.

The tube described above has a substantially rectangular cross-section. However, the invention is equally applicable to tubes with other shapes, particularly triangular, pentagonal, hexagonal or other polygonal shapes.

The above-described embodiment has only one stabilizer However, two or more longitudinally space stabilizers may be provided on the same side and/or on opposite lateral sides at the substantially same or at different longitudinal positions of the terminal fitting.

Although the above embodiment refers to a male terminal fitting, the invention is equally applicable to a female terminal fitting.

What is claimed is:

1. A terminal fitting, comprising: a substantially polygonal tube bent from a sheet of material to define a plurality of walls, at least one stabilizer formed at one of said walls of the tube by cutting and bending the sheet of material so that at least one cut hole is formed in the tube during formation of the stabilizer, and at least one closing plate bulging from one of said walls of the tube, the closing plate being disposed and configured for at least partly closing the cut hole, wherein the closing plate is folded such that a front part of the closing plate is placed on a rear part thereof.

2. The terminal fitting of claim 1, wherein the tube has a rear end formed with an opening, and the terminal fitting further comprising a closing piece formed unitarily with the closing plate and at least partly closing the opening.

3. The terminal fitting of claim 1, wherein the closing plate extends along forward and backward directions substantially parallel with an area of the sheet material to be formed into the polygonal tube and at a widthwise outer side thereof.

4. The terminal fitting of claim 1, wherein the cut hole is closed by end edges of both front and rear parts of the closing plate.

5. The terminal fitting of claim 1, wherein the closing plate has a length along forward and backward directions that at least substantially equals a corresponding dimension of the cut hole.

6. The terminal fitting of claim 1, wherein the stabilizer is formed by a substantially U-shaped slit in a base wall of the terminal fitting, opposite ends of the slit being substantially at a bend between the base wall and an adjacent side wall of the tube.

7. A terminal fitting, comprising: a substantially rectangular tube bent from a sheet of material to define a bottom wall, first and second side walls bent unitarily from opposite first and second sides of the bottom wall and a top wall bent unitarily from a top end of the first side wall towards the second side wall so that the top wall is substantially opposed to the bottom wall, at least one stabilizer substantially coplanar with the second side wall and extending unitarily down from the second side wall to a position lower than the bottom wall, portions of the bottom wall aligned with the stabilizer and substantially adjacent the second side wall including at least one cut hole formed during formation of the stabilizer, and at least one closing plate bent unitarily from the top wall into a position in the rectangular tube substantially adjacent to the second side wall and at a position substantially aligned with the cut hole, the closing plate being formed into a nonplanar shape that at least partly closes the cut hole.

8. The terminal fitting of claim 7, wherein the tube has a rear end formed with an opening, and the terminal fitting further comprising a closing piece formed unitarily with the closing plate and at least partly closing the opening.

9. The terminal filling of claim 7, wherein the closing plate has a length along forward and backward directions that at least substantially equals a corresponding dimension of the cut hole.

10. The terminal filling of claim 7, wherein at least a portion of the closing plate includes an embossment for further closing the cut hole.

11. The terminal filling of claim 7, wherein the closing plate is substantially adjacent the first side wall.

12. The terminal fitting of claim 7, wherein the closing plate is folded such that a front part of the closing plate is placed on a rear part thereof.

13. The terminal fitting of claim 12, wherein the cut hole is closed by end edges of both front and rear parts of the closing plate.

* * * * *